US011033111B2

(12) United States Patent
Rochecouste et al.

(10) Patent No.: US 11,033,111 B2
(45) Date of Patent: Jun. 15, 2021

(54) ERGONOMIC CHAIR

(71) Applicant: HARMONI-US PTY. LTD., Glen Iris (AU)

(72) Inventors: Annick Marie Lourdes Rochecouste, Camberwell (AU); John Rochecouste, Southbank (AU)

(73) Assignee: HARMONI-US PTY. LTD., Glen Iris (AU)

( * ) Notice: Subject to any disclaimer, the term of this patent is extended or adjusted under 35 U.S.C. 154(b) by 0 days.

(21) Appl. No.: 16/615,928

(22) PCT Filed: May 24, 2018

(86) PCT No.: PCT/IB2018/053677
§ 371 (c)(1),
(2) Date: Nov. 22, 2019

(87) PCT Pub. No.: WO2018/215962
PCT Pub. Date: Nov. 29, 2018

(65) Prior Publication Data

US 2020/0146457 A1 May 14, 2020

(30) Foreign Application Priority Data

May 24, 2017 (AU) ..... 2017901975

(51) Int. Cl.
*A47C 4/54* (2006.01)
*A47C 1/028* (2006.01)
(Continued)

(52) U.S. Cl.
CPC ..... *A47C 9/002* (2013.01); *A47C 4/54* (2013.01); *A47C 7/0213* (2018.08); *A47C 7/14* (2013.01);
(Continued)

(58) Field of Classification Search
CPC ..... A47C 4/54; A47C 7/0213; A47C 7/14; A47C 7/40; A47C 7/42; A47C 7/54; A47C 7/543; A47C 9/002; A47C 13/00
(Continued)

(56) References Cited

U.S. PATENT DOCUMENTS 343,192 A * 6/1886 Packwood ..... A47C 13/00 297/118
997,737 A 7/1911 Bezold
(Continued)

FOREIGN PATENT DOCUMENTS

CN 201676454 U 12/2010
CN 203987033 U 12/2014
(Continued)

OTHER PUBLICATIONS

Corresponding International Application No. PCT/IB2018/053677—International Search Report, dated Jun. 26, 2018.
(Continued)

*Primary Examiner* — Rodney B White
(74) *Attorney, Agent, or Firm* — Curatolo Sidoti Co., LPA; Salvatore A. Sidoti; Floyd Trillis, III

(57) ABSTRACT

A convertible seat including:
a support frame; and
a user support having a support surface on one side defining a rounded periphery, the user support being movable from a first configuration supported by the support frame with the rounded periphery presented upwardly, to a second configuration supported by the support frame such that a seat or seat base is presented upwardly, the seat or seat base being substantially flat or at least less rounded than the rounded periphery, with the support surface being stowed substantially below the seat or seat base in the second configuration.
(Continued)

The seat allows the attainment in a single unit both the healthy balance/core-strengthening of a fitness chair and a conventional chair.

14 Claims, 5 Drawing Sheets

(51) Int. Cl.

| | |
|---|---|
| ***A47C 1/03*** | (2006.01) |
| ***A47C 7/54*** | (2006.01) |
| ***A47C 9/00*** | (2006.01) |
| ***A47C 7/02*** | (2006.01) |
| ***A47C 7/14*** | (2006.01) |
| ***A47C 7/42*** | (2006.01) |
| ***A47C 13/00*** | (2006.01) |

(52) U.S. Cl.
CPC ..... *A47C 7/42* (2013.01); *A47C 7/543* (2013.01); *A47C 13/00* (2013.01)

(58) Field of Classification Search
USPC ..... 297/1, 3, 105, 188.08, 188.09, 188.04, 297/452.41
See application file for complete search history.

(56) References Cited

U.S. PATENT DOCUMENTS 3,536,359 A * 10/1970 Amos ..... A47C 13/00 297/462
4,361,356 A * 11/1982 Tunick ..... A47C 13/00 206/523
4,438,919 A * 3/1984 Gamzo ..... A63B 69/0022 280/87.03
5,690,389 A * 11/1997 Ekman ..... A47C 3/16 297/452.41 X
5,833,587 A * 11/1998 Strong ..... A63B 21/154 482/123
6,070,943 A * 6/2000 Guery-Strahm ..... A47C 3/16 297/452.41 X
6,116,682 A * 9/2000 Baur ..... A47C 3/12 297/118
6,257,668 B1 * 7/2001 Chou ..... A47C 1/03 297/411.32
6,447,070 B1 * 9/2002 Ekman ..... A47C 3/16 297/452.41 X
6,461,284 B1 * 10/2002 Francavilla ..... A61H 1/0218 482/121
6,520,578 B1 * 2/2003 Jospa ..... A61G 15/005 297/452.41 X
6,616,238 B1 * 9/2003 Guery-Strahm ..... A47C 9/002 297/452.41 X
6,702,388 B1 * 3/2004 Chiu ..... A47C 4/54 297/452.41 X
6,730,005 B1 * 5/2004 Liao ..... A47C 3/16 446/220
6,746,372 B2 * 6/2004 Hsu ..... A47C 9/002 482/123
6,832,817 B1 * 12/2004 Chiu ..... A47C 4/54 297/452.41 X
7,140,677 B1 * 11/2006 Chiu ..... A47C 7/444 297/181
7,341,548 B2 * 3/2008 Heitzman ..... A47C 4/54 482/142
7,588,522 B2 * 9/2009 Heitzman ..... A47C 4/54 297/452.41 X
7,674,216 B1 * 3/2010 Bolling ..... A63B 23/03541 482/142
7,832,805 B1 * 11/2010 Lai ..... A47C 1/03 297/411.38
7,942,796 B2 * 5/2011 Signorile ..... A63B 26/003 482/142
8,056,976 B1 * 11/2011 Polk ..... A47C 9/002 297/271.5
8,235,878 B2 * 8/2012 Signorile ..... A63B 26/003 482/142
8,721,005 B2 * 5/2014 Mankin ..... A47C 4/00 297/452.41
8,915,826 B2 * 12/2014 Publicover ..... B05B 17/00 482/77
8,919,881 B2 * 12/2014 Bay ..... A47C 7/543 297/311
8,926,483 B1 1/2015 Holloway
9,079,067 B2 * 7/2015 Huber ..... A63B 22/0605
9,084,909 B1 * 7/2015 Henley ..... A63B 23/02
9,408,469 B1 * 8/2016 Chiu ..... A47C 9/002
9,415,276 B1 * 8/2016 Hao ..... A63B 21/02
9,713,383 B2 * 7/2017 Hsu ..... A47C 4/54
9,919,185 B1 * 3/2018 Qiubo ..... A47C 9/002
10,021,983 B2 * 7/2018 Mark ..... A47C 9/005
10,279,211 B2 * 5/2019 Chiu ..... A63B 21/4027
10,426,269 B1 * 10/2019 O'Hara ..... A47C 1/03
10,512,336 B1 * 12/2019 Henderson ..... A63B 41/00
2004/0245838 A1 * 12/2004 Chiu ..... A47C 4/54 297/452.41
2004/0256532 A1 * 12/2004 Liao ..... A63B 22/18 248/346.01
2005/0023876 A1 * 2/2005 Savage ..... A47C 7/42 297/378.1
2007/0164594 A1 * 7/2007 Yang ..... A47C 1/03 297/411.32
2009/0325770 A1 * 12/2009 Baschnagel ..... A63B 22/18 482/142
2011/0057488 A1 * 3/2011 Marten ..... A47C 3/0252 297/217.1
2011/0183827 A1 * 7/2011 Radi ..... A63B 21/0552 482/140
2012/0299357 A1 * 11/2012 Newman ..... A47C 4/54 297/452.41
2013/0005550 A1 * 1/2013 Nagy ..... A47C 9/002 482/146
2013/0154333 A1 * 6/2013 Wu ..... A47C 9/002 297/452.23
2014/0210249 A1 * 7/2014 Barnett ..... A47C 9/002 297/452.41
2014/0265495 A1 9/2014 Bay
2017/0120111 A1 * 5/2017 McBride ..... A63B 21/068
2018/0304121 A1 * 10/2018 Osler ..... A63B 21/0004
2018/0310712 A1 * 11/2018 Zanayed ..... A47C 3/30

FOREIGN PATENT DOCUMENTS

DE 102013110674 B3 2/2015
JP 2006320582 A 11/2006

OTHER PUBLICATIONS

Corresponding International Application No. PCT/IB2018/053677—International Written Opinion, dated Jun. 26, 2018.

* cited by examiner

ERGONOMIC CHAIR

CROSS REFERENCE TO RELATED APPLICATIONS

This application is a national stage application of International Application No. PCT/IB2018/053677, filed 24 May 2018, which claims priority from Australian Patent Application No. 2017901975, filed 24 May 2017, which applications are incorporated herein by reference.

FIELD OF THE DISCLOSURE

This disclosure relates to an ergonomic seat. In particular, it relates to a convertible seat which is able to be converted from a normal seat to a seat where the user will experience a core-strengthening or balancing experience.

BACKGROUND OF THE DISCLOSURE

Inflatable balls and hemispheres have been used since the late 20th century as fitness and balance training devices. The inflatable balls are generally known as balance balls or Swiss balls. The inflated hemisphere type devices are generally known as BOSU™ balls. The BOSU™ type balls generally consist of an inflated rubber hemisphere attached to a rigid platform.

While Swiss balls have been used for sitting at a desk to work or study, a user may find it impossible to stay seated on such a ball for extended periods and therefore would also require an office chair.

It is therefore an object of the present disclosure to incorporate a balance surface (such as an inflatable rounded surface) into a seat or chair so that the seat or chair can be converted from a balance/core-strengthening seating experience to a normal seating experience for the user.

It is also an object of the present disclosure to provide a convertible seat or chair, which provides the public with a useful choice over known convertible seats or chairs.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE DISCLOSURE

In accordance with a first aspect of the present disclosure, there is provided a convertible seat including:

a support frame; and a user support having a support surface on one side defining a rounded periphery, the user support being movable from a first configuration supported by the support frame with the rounded periphery presented upwardly, to a second configuration supported by the support frame such that a seat or seat base is presented upwardly, the seat or seat base being substantially flat or at least less rounded than the rounded periphery, with the support surface being stowed substantially below the seat or seat base in the second configuration.

The user support may be invertible to move from the first configuration to the second configuration.

The adjustment of the user support from the first configuration to the second configuration may be manually effected and/or mechanically assisted.

The support frame may include a castored base and support column with an adjustable gas lift as known in the art.

Further, the support frame may include a support ring (either continuous or discontinuous) for supporting the user support in either the first or second configuration. When the rounded periphery is moved to face downwards, the rounded periphery may be inserted through the support ring and the remainder of the support frame may accommodate the rounded periphery.

The support ring may be in the form of an annular seat with a surrounding rim (either or both may be continuous or discontinuous). The user support may have a peripheral flange which is seatable on the annular seat within the surrounding rim. The annular seat may support the peripheral flange in both the first and the second configurations.

The user support may be manually adjustable. For example, the user support may be removable from the support frame and replaceable within the support frame to change from the first configuration to the second configuration and vice versa.

The support frame may include a housing to receive the rounded periphery in the second configuration of the user support. In this configuration, the rounded periphery may be hidden from view. The housing may be in the form of shell such as a metal structure with a plastic shroud. In another embodiment, the housing may take the form of a metal "wire" frame.

In an alternative form of the disclosure, the support frame may include pivots to allow the user support to pivot from the first configuration to the second configuration and vice versa. In this embodiment, the support frame may include cradle arms to provide pivots and accommodate the user support therebetween in both configurations.

The user support has a support surface (defined as the rounded periphery) which may be attached to a rigid platform. The rigid platform may define the flange mentioned above. The rounded periphery which is convex may be part-spherical e.g. hemispherical. Preferably the support surface is of flexible material which may also be elastically extensible. The support surface may also be shape resilient. For example, the support surface may be formed by an inflatable dome.

As an alternative to the inflatable dome discussed above, the user support could take the form of a shell having one side which is domed/round and the other side of which presents an annular rim. The annular rim could define the seat base in the second configuration.

In yet another embodiment of the user support, the support surface may be comprised of flexible material such as rubber, which is movable by gas pressure from a distended first configuration to a deflated second configuration below the seat or seat base.

The other side of the user support to the rounded periphery may present a substantially flat seat for a user or the seat base to which a seat portion may be attached. The seat portion may be in the form of a detachable cushion which may be removably attached to the seat base. For example, the removable attachment may be a bayonet type attachment or a hook and loop fastener. Preferably, the shape of the mating surfaces of the seat portion and the seat base are commensurate in shape.

In a particular embodiment, the user support comprises an inflatable surface that forms the support surface, this surface being affixed to a plate, the side of which plate remote from the inflatable surface comprises a conventional seating surface. Both inflatable surface and conventional seating surface may be removably attached to the plate, such that they are interchangeable, allowing a variety of seating surfaces to be used.

The seat and seat base are defined as substantially flat or at least less rounded than the rounded periphery. This means that the radius of curvature will be larger than the radius of curvature for the rounded periphery.

Alternatively, the seat base may be defined on the support frame such that when the user support is moved to the second stowed configuration, the seat base is revealed on the support frame.

The convertible seat may be in the form of a chair or a stool. The chair may be provided with a backrest, a headrest and/or arm rests. The backrest, the headrest and/or the armrests may pivot to a stowage position.

A footrest may also be provided for use in conjunction with the convertible seat.

In accordance with a second aspect of the disclosure, there is provided a convertible seat including:

a support frame;

a seat surface mounted on the support frame to support a user, the seat surface being changeable from a first form having a rounded periphery to a second form having a flat surface or at least a surface which is less rounded than the rounded periphery; and movable arm rests movable between a first position to support a user's arms and a stowage position below the seat surface.

The arm rests may be supported by pivoting arms. The pivoting arms may be attached to the support frame.

The convertible seat may also include a backrest which has an in-use position and a reclined stowage position.

Any of the features described above in connection with the first aspect of the disclosure, may be applied to the second aspect of the disclosure.

In accordance with a third aspect of the disclosure, there is provided a convertible chair including:

a support frame;

a user support having a support surface on one side defining a rounded periphery, the user support being movable from a first configuration supported by the support frame with the rounded periphery presented upwardly, to a second configuration supported by the support frame such that a seat or seat base is presented upwardly, the seat or seat base being substantially flat or at least less rounded than the rounded periphery; and a backrest with an opening, the user support being stowable with the rounded periphery received in the opening of the backrest.

The user support may be reversible relative to the backrest so that the rounded periphery faces rearwardly with a cushioned surface of the user support disposed in the opening.

Any of the features described above in connection with the first two aspects of the disclosure may have application to the third aspect of the disclosure.

As used herein, except where the context requires otherwise, the term "comprise" and variations of the term, such as "comprising", "comprises" and "comprised", are not intended to exclude further additives, components, integers or steps.

It will be understood that the disclosure disclosed and defined in this specification extends to all alternative combinations of two or more of the individual features mentioned or evident from the text or drawings. All of these different combinations constitute various alternative aspects of the disclosure.

Further aspects of the disclosure and further embodiments of the aspects described in the preceding paragraphs will become apparent from the following description, given by way of example and with reference to the accompanying drawings.

BRIEF DESCRIPTION OF THE DRAWINGS

In order that the disclosure may be more fully understood, one embodiment will now be described, by way of example with reference to the figures in which.

DETAILED DESCRIPTION OF THE EMBODIMENTS

Figure 1:
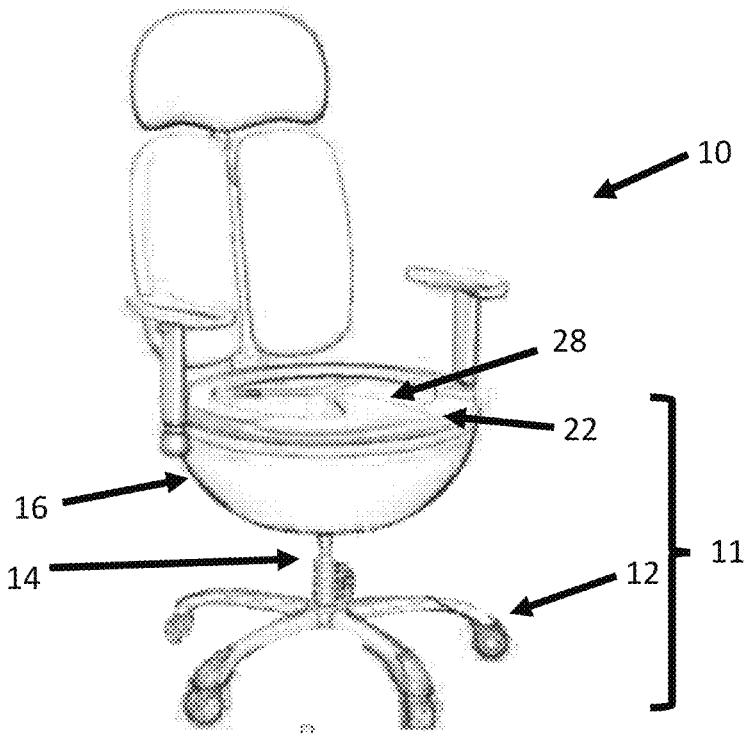
FIG. 1 is a perspective view of a convertible chair according to a first particular embodiment of the disclosure.

In FIG. 1, a convertible chair 10 includes a support frame 11, which comprises a castored base 12 with an upright stem 14 incorporating a gas lift. The castored base and the upright stem 14 are in a form well known to those skilled in the art.

Figure 2:
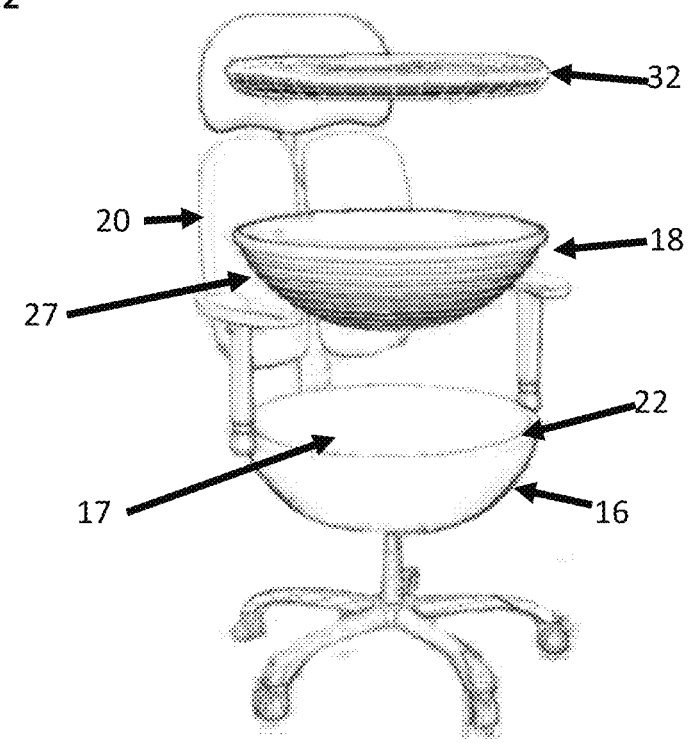
FIG. 2 is an exploded view of the convertible chair of FIG. 1 illustrating a user support and a detachable seat portion.

The support frame also includes a housing 16. The housing may be in the form of a metal support structure with a plastic shroud. As can be seen in FIG. 2, the housing 16 has the form of a shell which is upwardly concave to receive the rounded periphery 27 of the user support 18. The housing 16 may incorporate components (not shown) for lumbar adjustment on the backrest 20.

The housing 16 has an upper support ring 22. The support ring 22 supports the user support 18 in a manner which will be explained. The support ring 22 may be continuous or discontinuous. For example, the support ring may comprise arcuate segments around the top of the housing 16. The support ring 22 includes a surrounding rim 24

The user support 18 is in the form of an inflatable dome 26 mounted to a rigid platform 28. The inflatable dome 26 defines a support surface in the form of rounded periphery 27. The rigid platform defines a peripheral flange 28 protruding from the rounded periphery 27. The peripheral flange 28 defines a shoulder 30 which is seated on the surrounding rim 24.

In a further particular form of the disclosure (not shown), the support ring 22 also includes an annular seat (not shown)

below the surrounding rim 24. In this embodiment, when the user support is in the second inverted configuration, the shoulder 30 is seated on the annular seat and the surrounding rim 24 surrounds the rigid platform 28.

Figure 7:
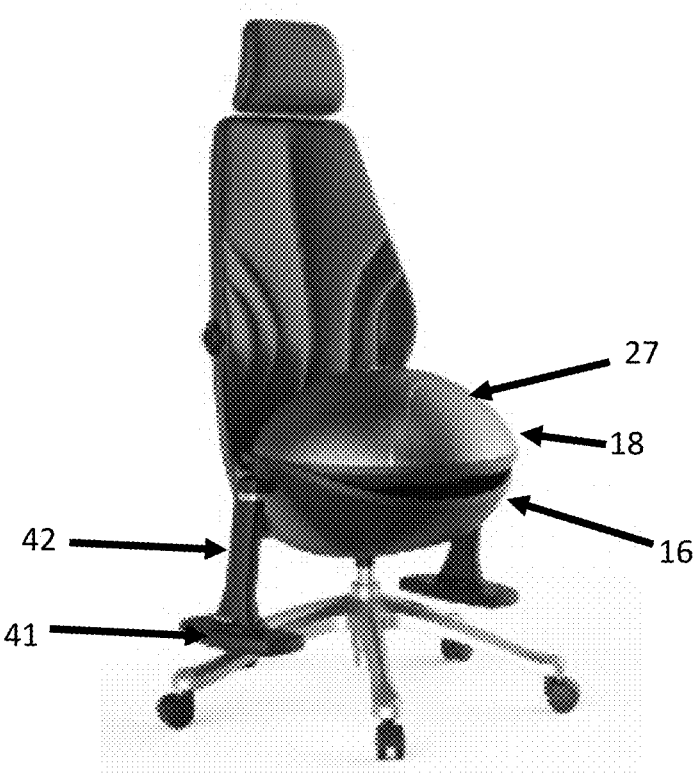
FIG. 7 is a perspective view of the convertible chair shown in FIG. 6 with the user support shown in the first configuration with the arm rests shown in a stowage position.
Figure 8:
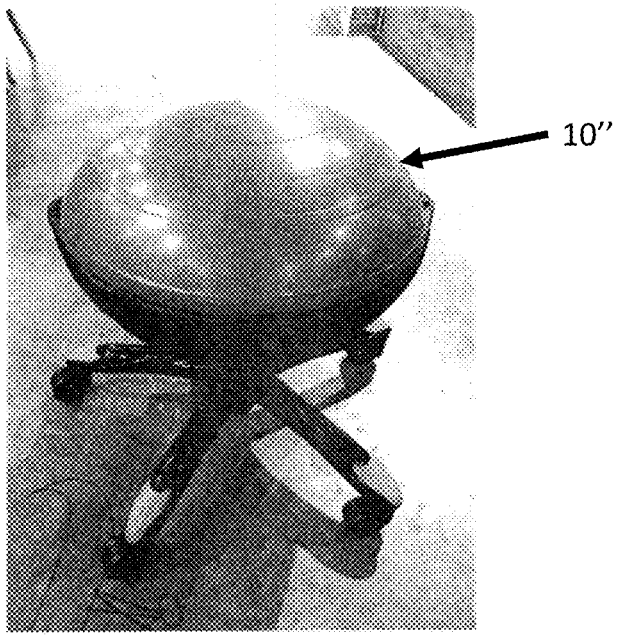
FIG. 8 is another particular embodiment illustrating a convertible seat in the form of a stool.

In FIGS. 1 and 2, the user support 18 is shown in the second, inverted configuration. The user support 18 may also be manually moved to a first configuration as illustrated in FIG. 7. In this configuration, it will be appreciated that the side of the rigid platform 28 opposite to the shoulder 30 will seat on the annular seat within the housing 16.

The housing 16, forming part of the support frame 11 thus accommodates the rounded periphery 27 of the user support 18 when the user support 18 is in the second inverted configuration. In this way, the rounded periphery 27 is hidden from view and the chair 10 more closely resembles a conventional office chair.

Figure 4:
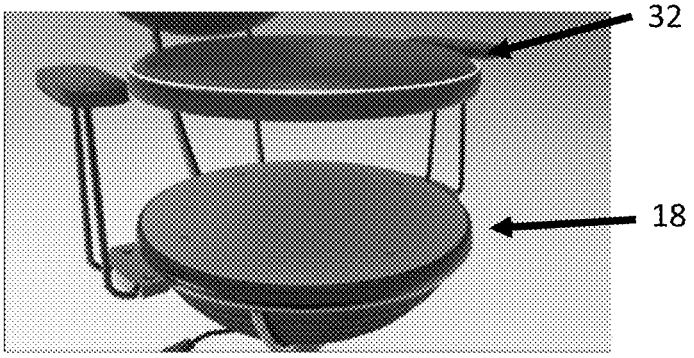
FIG. 4 is an exploded view illustrating the attachment of the detachable seat portion with the user support.
Figure 5:
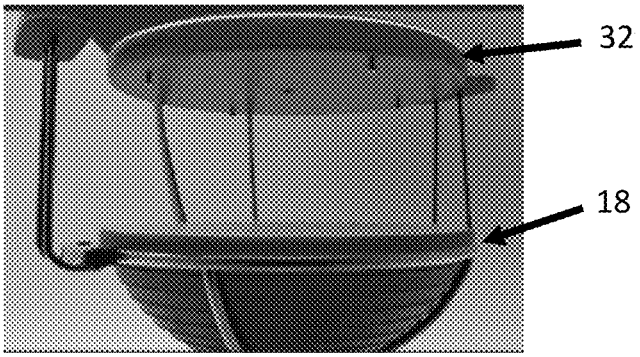
FIG. 5 is an alternative view of the detachable seat portion and the user support as shown in FIG. 4.

FIG. 2 also illustrates the detachable seat portion 32. Although not shown, the rigid platform 28 of the user support 18 has a shallow circular recess in its outer face. This circular recess receives at least part of the detachable seat portion 32 therein. As can be seen from FIGS. 4 and 5, the detachable seat portion 32 and the user support 18 may have a bayonet type connection.

Instead of a detachable seat portion 32, the side of the user support opposite to the rounded periphery may be cushioned and/or upholstered to serve as the users seat in the second configuration.

Figure 3:
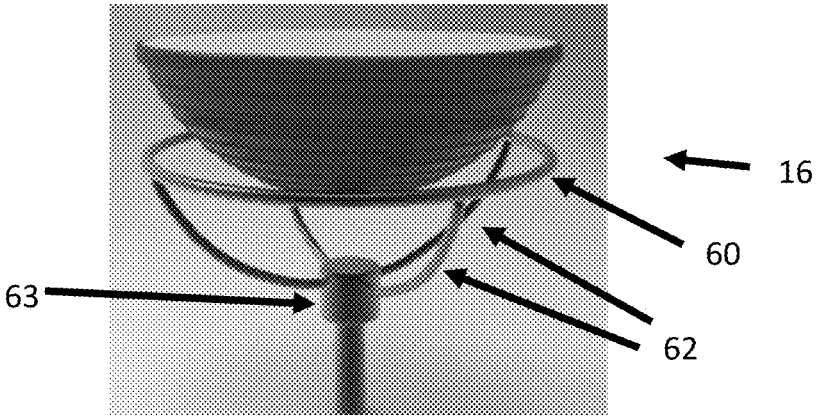
FIG. 3 shows an exploded view of an alternative support housing.

FIG. 3 depicts an alternative housing 16, this one being formed from three tubular members, one circular member 60 providing the upper support ring, and four quarter-circular members 62 attached evenly spaced around the circular member 60 and extending downwardly therefrom to join a boss 63 at the top of the gas strut (14 in FIG. 1)

Figure 6:
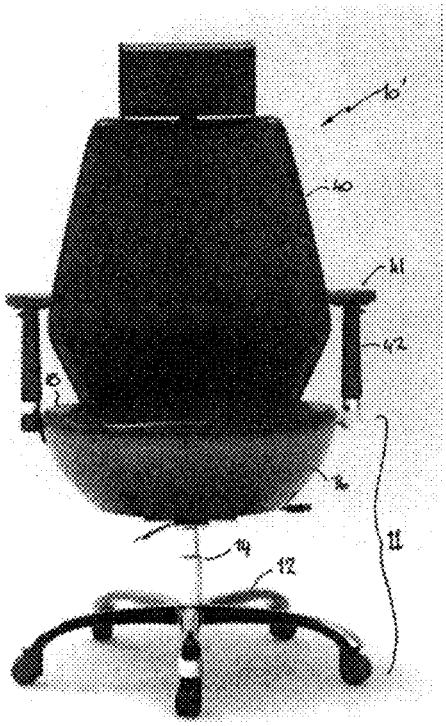
FIG. 6 is a convertible chair showing the user support in the second, inverted, stowage configuration and arm rests in a in-use position.

FIG. 6 illustrates a chair, generally indicated as 10', which is a similar embodiment to those shown in FIGS. 1 and 2, except that it has a different backrest 40. The convertible chair 10' is similar in many respects to the convertible chair 10 of FIGS. 1 and 2, and thus the same numerals are used to represent the same parts. The main difference is the inclusion of stowable arm rests 41. The arm rests 41 are attached to pivotable arms 42 which are pivotally mounted to the housing 16. As can be seen from a comparison of FIGS. 6 and 7, the pivotable arms 42 are pivotal from a substantially upright configuration in which the arm rest 41 is uppermost to an inverted configuration in which the arm rest 41 is below the pivotable arm. In this stowage position, the arm rests are out of the way, allowing the user to balance on the rounded periphery 27 of the user support 18. Additionally, the backrest 40 is reclinable and indeed this encourages the user to rely exclusively on balance to maintain her or his position on the rounded periphery.

Figure 9:
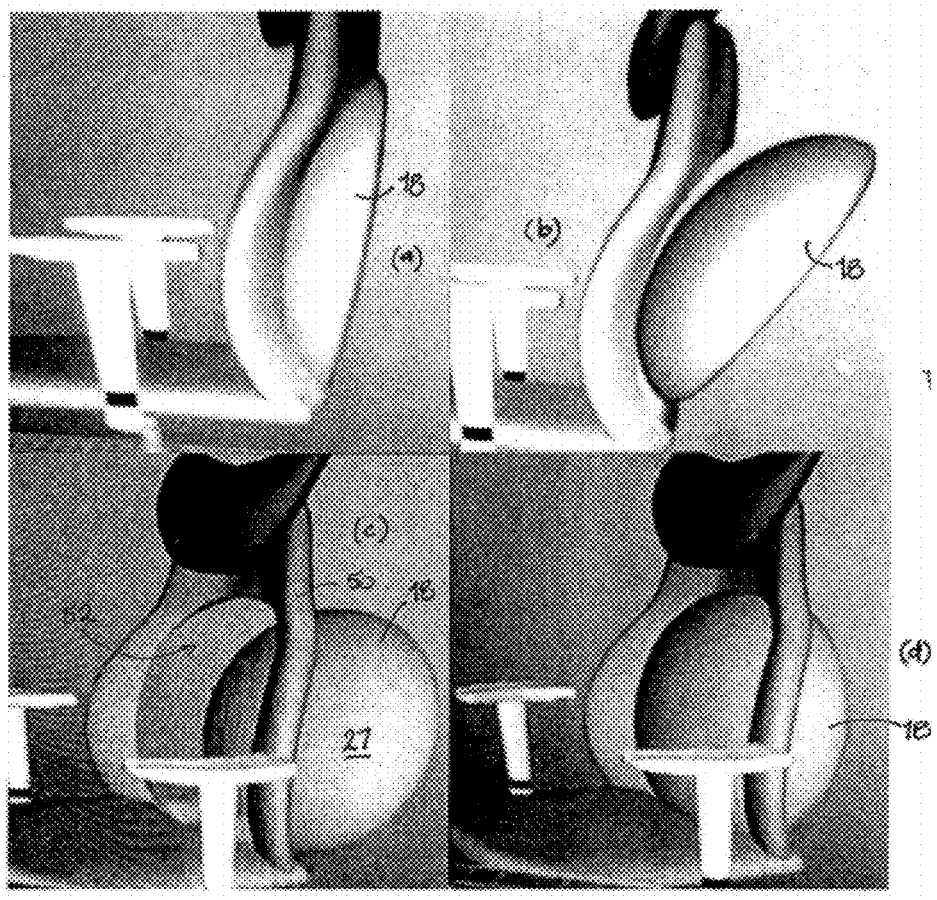
FIG. 9 is another particular embodiment illustrating the user support being stowed in a backrest.

FIG. 9 illustrates another embodiment of the disclosure in which the convertible seat is in the form of a stool 10". The stool 10" is similar in many respects to the chair illustrated in the previous embodiments, except it is without a backrest and arm rests.

FIG. 9 illustrates another embodiment. In this embodiment, the backrest 50 is provided with an opening 52. In this embodiment, the user support 18, instead of being stowed below the seat or the seat base, is stowed in the backrest 50. In a particular embodiment, the rounded periphery 27 is arranged to protrude through the opening 52. This may provide an additional back stretch for the user.

Alternatively, the user support 18 may be arranged with the rounded periphery 27 facing rearwardly (not shown). In this embodiment, that side of the user support 18 remote from the rounded periphery 27 is suitably cushioned and upholstered to provide a comfortable backrest for the user.

Figure 10:
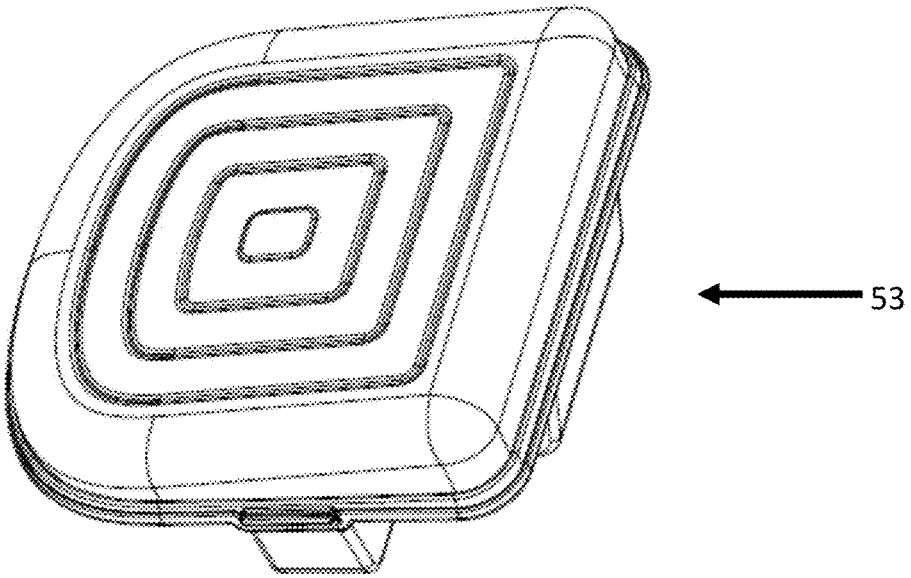
FIG. 10 depicts a perspective view of a further particular embodiment of a user support.
Figure 11:
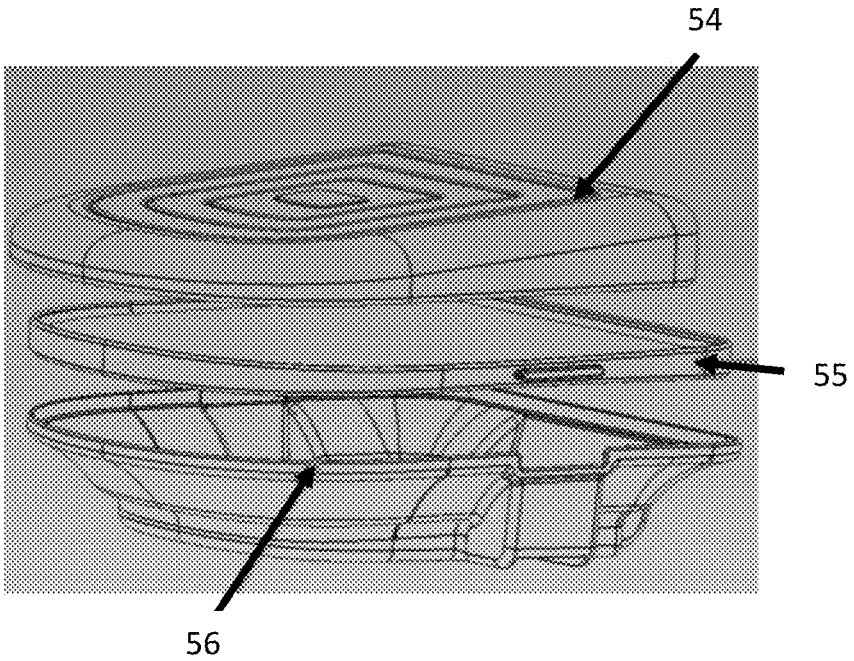
FIG. 11 is an exploded view of the embodiment of FIG. 10, showing the components.

In FIGS. 10 and 11, there is depicted a particular user support, generally indicated as 53, which is modular in construction. The user support consists of an inflatable portion 53, a base plate 54 to which it is removably attached, and a support frame 55, that supports the user support and in which it is invertible. The side of the plate 54 remote from that to which the inflatable portion is attaches comprises a normal seat, which may be of any suitable known constitution (upholstered foam, gel, etc.). This particular arrangement is particularly versatile, allowing a variety of seating arrangements The foregoing describes only some selected embodiments of the present disclosure and modifications may be made thereto without departing from the scope of the disclosure.

The invention claimed is:

1. A convertible seat including:

a support frame; and a user support having a support surface on one side defining a rounded periphery, the user support being movable from a first configuration supported by the support frame with the rounded periphery presented upwardly, to a second configuration supported by the support frame such that a seat or seat base is presented upwardly, the seat or seat base being substantially flat or at least less rounded than the rounded periphery, with the support surface being stowed substantially below the seat or seat base in the second configuration, wherein the seat comprises a backrest having an opening, the user support being stowable in the opening with the rounded periphery received in the opening.

2. The convertible seat according to claim 1, in which the support frame includes a support ring either continuous or discontinuous for supporting the user support in either the first or second configuration.

3. The convertible seat according to claim 2, in which the support ring is in the form of an annular seat with a surrounding rim.

4. The convertible seat according to claim 3, in which the user support has a peripheral flange which is seatable on the annular seat within the surrounding rim, the annular seat supporting the peripheral flange in both the first and the second configurations.

5. The convertible seat according to claim 1, in which the support frame includes a housing to receive the rounded periphery in the second configuration of the user support.

6. The convertible seat according to claim 1, in which the support frame includes pivots to allow the user support to pivot from the first configuration to the second configuration and vice versa.

7. The convertible seat according to claim 1, in which the adjustment of the user support from the first configuration to the second configuration may be manually effected and/or mechanically assisted.

8. The convertible seat according to claim 1, in which the support surface is formed by an inflatable dome.

9. The convertible seat according to claim 1, in which the support surface is comprised of flexible material such as rubber, which is movable by gas pressure from a distended first configuration to a deflated second configuration below the seat or seat base.

10. The convertible seat according to claim 1, in which the seat base presents a substantially flat surface, to which a seat portion may be attached.

11. The convertible seat according to claim 10, in which the seat portion is detachable from the seat base.

12. The convertible seat according to claim 1, in which the seat comprises movable arm rests, movable between a first arm support position and a stowage position below the seat surface.

13. The convertible seat according to claim 1, in which the user support comprises an inflatable surface that forms the support surface, this surface being affixed to a plate, at least one side of which plate remote from the inflatable surface comprises a conventional seating surface.

14. The convertible seat according to claim 13, in which the user support is modular in construction, at least one of the user support and the conventional seating surface being detachable from the plate.

* * * * *